US006593696B2

(12) United States Patent
Ding et al.

(10) Patent No.: US 6,593,696 B2
(45) Date of Patent: Jul. 15, 2003

(54) LOW DARK CURRENT LINEAR ACCELERATOR

(75) Inventors: Xiaodong Ding, El Cerrito, CA (US); Kenneth Whitham, Alamo, CA (US)

(73) Assignee: Siemens Medical Solutions USA, Inc., Melvern, PA (US)

( * ) Notice: Subject to any disclaimer, the term of this patent is extended or adjusted under 35 U.S.C. 154(b) by 0 days.

(21) Appl. No.: 10/039,424

(22) Filed: Jan. 4, 2002

(65) Prior Publication Data

US 2003/0025456 A1 Feb. 6, 2003

Related U.S. Application Data

(60) Provisional application No. 60/310,612, filed on Aug. 6, 2001.

(51) Int. Cl.[7] ..... H01J 25/10
(52) U.S. Cl. ..... 315/5.41; 315/505
(58) Field of Search ..... 315/5.41, 5.42, 315/505, 500, 5.39

(56) References Cited

U.S. PATENT DOCUMENTS 4,382,208 A * 5/1983 Meddaugh et al. ..... 315/5.41
4,988,919 A * 1/1991 Tanabe et al. ..... 315/5.41
5,132,593 A * 7/1992 Nishihara ..... 315/5.41
5,929,567 A * 7/1999 Kang et al. ..... 315/5.39
6,366,021 B1 * 4/2002 Meddaugh et al. ..... 315/5.41
6,465,957 B1 * 10/2002 Whitham et al. ..... 315/5.41

OTHER PUBLICATIONS

Assmann et al., "Observation of dark–current signals from the s–band structures of the slac linac[1]" ([1]Work supported by the Department of Energy, contract DE–AC03–76SF00515).
Xu et al., "RF breakdown studies in x–band klystron cavities" (Stanford Linear Accelerator Center).
Akasaka, N., "Dark current simulation in high gradient accelerating structure" (KEK, National Laboratory for High Energy Physics).
Varian: Oncology Systems: "Key Features", http://.varian-.com/onc/upg115a.html (1 pg.) download Nov. 16, 2001.
Varian: Oncology Systems: "Respiratory Gating", http://www.varian.com/onc/prd057.html (3 pgs.) download Nov. 6, 2001.

* cited by examiner

*Primary Examiner*—Don Wong
*Assistant Examiner*—Ephrem Alemu

(57) ABSTRACT

A method, system, and apparatus for providing reduced dark current in a linear accelerator includes a cavity having an input aperture and an output aperture, and a particle source coupled to the input aperture, the input aperture having a radius greater than a radius of the output aperture.

16 Claims, 4 Drawing Sheets

LOW DARK CURRENT LINEAR ACCELERATOR

This application claims benefit to Prov. No. 60/310,612, filed Aug. 6, 2001.

BACKGROUND

The present invention relates generally to particle accelerators. More particularly, embodiments of the present invention relate to the reduction of dark current in particle accelerators.

Particle accelerators have been used for a number of years in various applications. For example, one common and important application is their use in medical radiation therapy devices. In this application, an electron gun is coupled to an input cavity of a linear accelerator. The electron gun provides a source of charged particles to the accelerator. The accelerator then accelerates the charged particles to produce an accelerated output beam of a desired energy for use in medical radiation therapy.

It is important to ensure that the beam output from a particle accelerator is generated efficiently and is of the desired energy. The energy and other characteristics of the beam are dependent upon the resonant frequency of the accelerator which in turn depends upon the shape and manufacture of the accelerator. The output characteristics of accelerators can be impaired as a result of the emission of unwanted electrons from the walls of the accelerator structure during operation. These unwanted electrons can be captured and accelerated by the accelerating fields in the device, resulting in the creation of so-called "dark current".

Dark current can impair the operating efficiency of a particle accelerator such as a linear accelerator. It would be desirable to provide an accelerator structure which can reduce dark current. It would further be desirable to provide an accelerator structure which can reduce dark current and which can be readily manufactured with few design changes to existing accelerator designs.

SUMMARY

To alleviate the problems inherent in the prior art, embodiments of the present invention provide a method, system and apparatus providing reduced dark current in linear accelerators. According to some embodiments of the present invention, a method, system, and apparatus for providing reduced dark current in a linear accelerator includes a cavity having an input aperture and an output aperture, and a particle source coupled to the input aperture, the input aperture having a radius greater than a radius of the output aperture.

In some embodiments, the input aperture and the output aperture are substantially circular in shape. In some embodiments, the accelerator further includes an anode plate, coupled between the particle source and the input aperture, where the anode plate has an anode aperture and a thickness. In some embodiments, the size of the anode aperture and a thickness of the anode plate are sized to attain a resonant frequency of the linear accelerator. In some embodiments, the radius of the input aperture is selected to reduce the dark current beam generated from the anode plate.

According to some embodiments of the present invention, a cavity for a linear accelerator includes an input aperture having a first radius, and an output aperture having a second radius smaller than the first radius, where the input cavity receives particles from a particle source, and directs the particles to the output aperture.

The present invention is not limited to the disclosed embodiments, however, as those skilled in the art can readily adapt the teachings of the present invention to create other embodiments and applications.

BRIEF DESCRIPTION OF THE DRAWINGS

The exact nature of this invention, as well as its objects and advantages, will become readily apparent from consideration of the following specification as illustrated in the accompanying drawings, in which like reference numerals designate like parts throughout the figures thereof, and wherein.

DETAILED DESCRIPTION

The following description is provided to enable any person skilled in the art to make and use the invention and sets forth the best modes contemplated by the inventor for carrying out the invention. Various modifications, however, will remain readily apparent to those skilled in the art.

Figure 1:
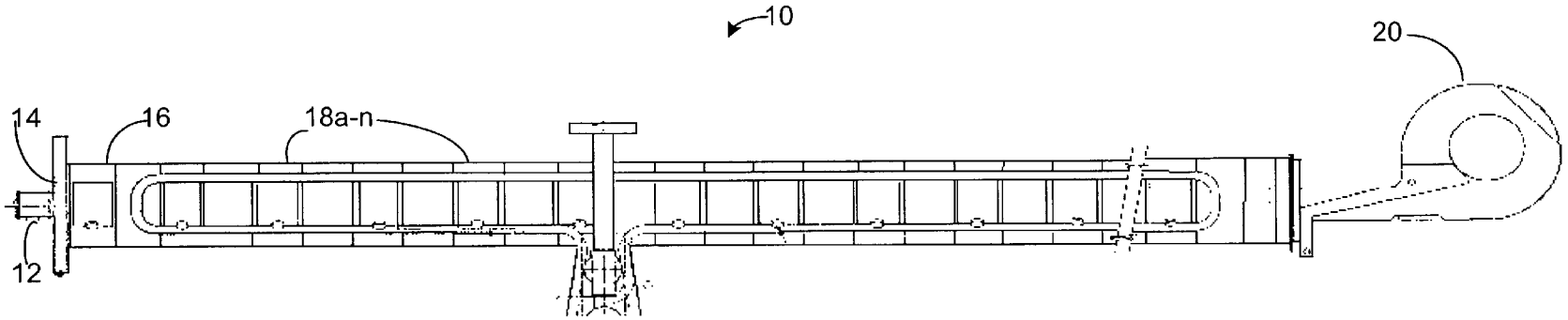
FIG. 1 is cross-section of an accelerator according to some embodiments of the present invention.

Referring first to FIG. 1, a block diagram of a standing-wave linear particle accelerator 10 according to one embodiment of the present invention is shown. As depicted in FIG. 1, particle accelerator 10 is an elongated structure that includes both an input side and an output side. In operation, an electron gun 12 (or other particle injector) is typically coupled to the input side of accelerator 10, while an accelerated particle beam is driven out of an output side, typically through a bending magnet structure 20 for delivery to a target or other device.

In a typical structure, as depicted in FIG. 1, electron gun 12 is coupled to a body 16 of accelerator 10 using a flange 14. Accelerator 10 includes a number of accelerating cavities 18*a–n*. Charged particles, input into accelerator 10 from electron gun 12 are bunched together in the first few accelerating cavities 18*a–n*. The bunch of charged particles will pass through each successive cavity during a time interval when the electric field intensity in that cavity is a maximum. Preferably, each of the cavities is shaped and tuned such that its resonant frequency ensures that the bunched electrons pass at the peak of intensity of each cavity.

Figure 2:
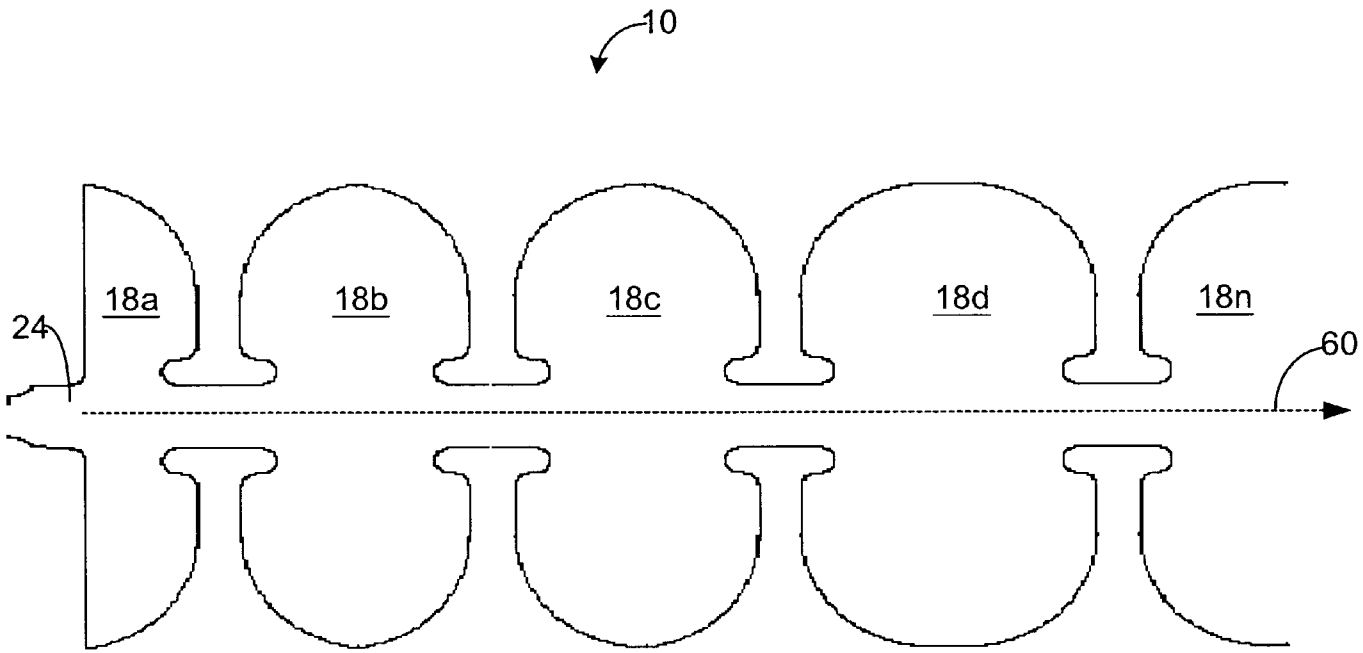
FIG. 2 is a partial cross-section depicting cavities of the accelerator of FIG. 1.

Referring now to FIG. 2, a partial cross-sectional view of cavities of a standing-wave linear particle accelerator 10 according to some embodiments of the present invention is shown. As depicted in FIG. 2, accelerator 10 includes a number of accelerating cavities 18*a–n*. Bunches of electrons are accelerated through openings in each successive cavity along a beam axis 60, toward an output end of accelerator 10. The first cavity of accelerator 10 is a half cavity 18*a* which abuts a flange (not shown) and which receives input particles from an electron gun (not shown) via an input cavity 24. Applicants have discovered that a significant portion of dark current which may be generated within accelerator 10 are generated in the first half cavity 18*a*. Typical accelerators are formed such that each of the cavities along beam axis 60 are formed having approximately the same size (e.g., the same radius).

Figure 3:
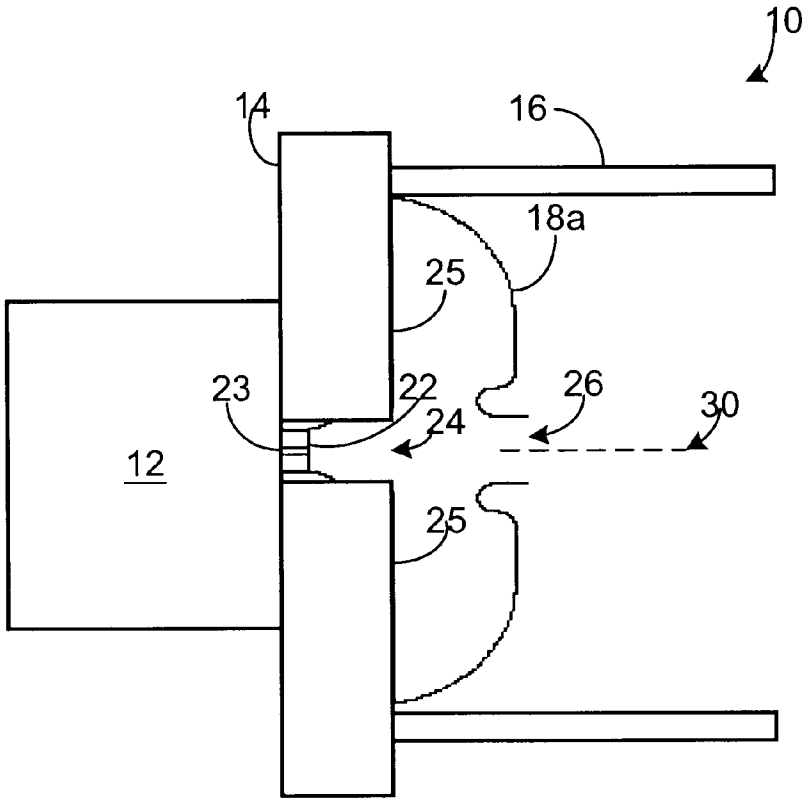
FIG. 3 is a partial cross-section of the accelerator of FIG. 1.

Referring now to FIG. 3, a partial cross-sectional view of one embodiment of a standing-wave linear particle accelerator 10 according some embodiments of the present invention is shown. In particular, FIG. 3 depicts an electron gun 12 coupled to a body 16 of accelerator 10 via a flange 14. A first half cavity 18*a* of accelerator 10 is shown. First half cavity 18*a* has an input aperture 24 and an output aperture 26. One side of first half cavity 18*a* is an anode plate 25 through which input aperture 24 is formed. Input aperture 24 is positioned to receive charged particles from electron gun 12. Generation and focusing of electrons is assisted with a gun anode 22 having an anode aperture 23.

Output aperture 26 couples the first half cavity 18*a* with another cavity 18*b*. First half cavity 18*a* is formed to direct and focus charged particles along a beam path 30 through subsequent cavities of accelerator 10.

Applicants have discovered that disruptive amounts of dark current can be generated in the first half cavity of accelerator 10. In particular, Applicants have discovered that anode plate 25 can become coated with oxides as a result of normal operation. In operation (particularly during high energy operation), electrons can be pulled from the surface of anode plate 25 and accelerated through accelerator 10 as dark current. This dark current can reduce the overall efficiency of accelerator 10.

Applicants have discovered that dark current generated in the first half cavity can be substantially reduced by modifying the size of input aperture 24. In particular, Applicants have discovered that dark current can be reduced by increasing the size of input aperture 24. In some embodiments, a radius of input aperture 24 is greater than a radius of output aperture 26. In some embodiments, a radius of input aperture 24 is selected to be greater than a radius of a dark current beam which is generated from electrons emitted from a surface of anode plate 25. The radius of the dark current beam generated from the surface of anode plate 25 can be modeled, for example, using the so-called "PARMELA" code developed for the simulation of linear accelerator effects and described in L. M. Young. "PARMELA", Los Alamos National Laboratory, LA-UR-96-1835, 1996, the contents of which are incorporated herein in their entirety.

In some embodiments, to compensate for the change in shape of first half cavity 18*a*, dimensions of anode plate 25 are modified, thereby maintaining the ability to generate a focused and efficient beam without the need to modify the overall accelerator design. For example, in some embodiments, the size of aperture 23 of anode plate 25 is increased. In some embodiments, a thickness of anode plate 25 is increased (Applicants believe this prevents RF fields from fringing into the electron gun). For example, the thickness of anode plate 25 may be increased to cut off the RF field and to provide proper focusing during beam transport. In some embodiments, the inner dimensions of first half cavity 18*a* may also be modified to maintain the resonant frequency of the cavity.

In some embodiments, gun anode 22 of electron gun 12 is also modified (e.g., by reducing the thickness of gun anode 22 and by varying the size of anode aperture 23 to compensate for the modifications to anode plate 25). Each of these modifications are made to ensure accelerator 10 may continue to operate efficiently and with desired output while enjoying lowered amounts of dark current.

Figure 4:
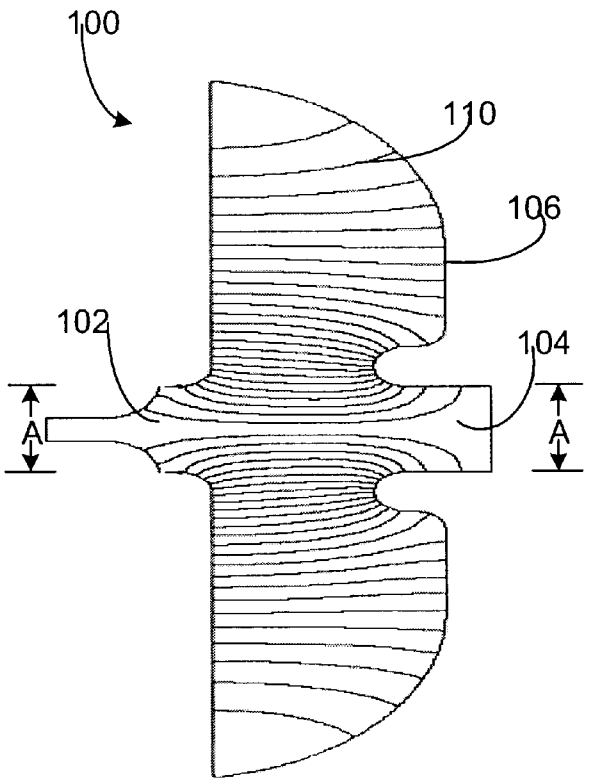
FIG. 4 is a partial cross-section of a first half cavity of the accelerator of FIG. 1.

An example embodiment will now be described by referring to FIGS. 4 and 5. Referring first to FIG. 4, a sample first half cavity 100 is shown which may be used in a linear accelerator of the type suitable for use in medical radiation therapy applications. First half cavity 100 has an input aperture 102 and an output aperture 104, each having a diameter "A" (that is, the size of input aperture 102 and the size of output aperture 104 are substantially similar). Sample first half cavity 100 is positioned between a flange (not shown, but similar to flange 14 of FIG. 3) and a second cavity (not shown, but similar to cavity 18*b* of FIG. 2).

An anode plate having an anode aperture is positioned to form a side of first half cavity 100 and to form input aperture 102. In an example configuration, first half cavity 100 has the following general dimensions: internal height of first half cavity appx. 3.133", an input cavity radius of appx. 0.197" and an output cavity radius of appx. 0.197". In the same example configuration, the gun anode has an aperture of appx. 0.2" and the anode plate has a thickness of appx. 0.475".

As depicted in FIG. 4, electric field characteristics are shown as modeled using PARMELA code and depicted as lines 110. As shown, the example configuration results in a focused beam directed through output aperture 104. Simulations indicated that a potentially disruptive amount of dark current was generated in this configuration.

Figure 5:
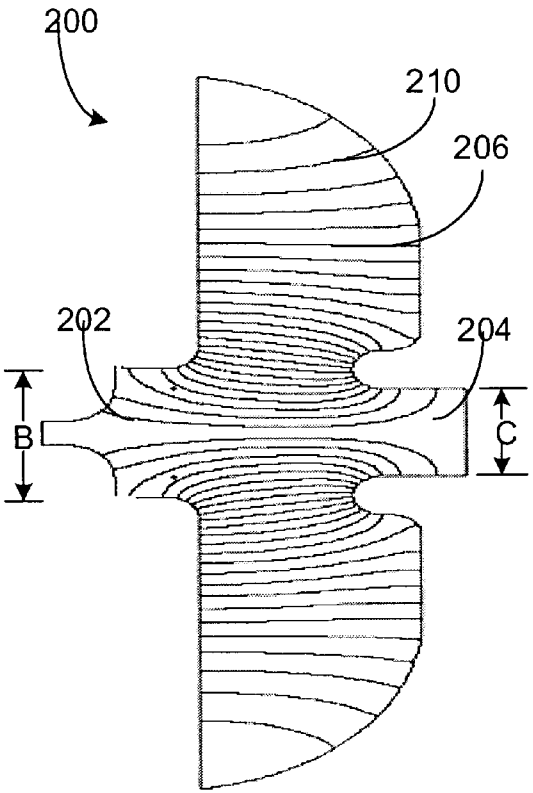
FIG. 5 is a further partial cross-section of a first half cavity of the accelerator of FIG. 1.

Referring now to FIG. 5, a first half cavity 200 is shown which has been fabricated using techniques of the present invention. Pursuant to embodiments of the present invention, input aperture 202 is larger than output aperture 204. First half input cavity 200 of FIG. 5 has been fabricated to produce similar beam output characteristics as first half cavity 100 of FIG. 4, but with reduced dark current. As a result, an accelerator using first half cavity 200 will enjoy greater efficiency and accuracy in operation.

First half cavity 200 is formed with the following dimensions: internal height of first half cavity is appx. 3.149" (appx. 0.016" greater than cavity 100), an input aperture 202 radius of appx. 0.276" (appx. 0.079" greater than input cavity 102), an output aperture 204 radius of appx. 0.197" (appx. 0.079" smaller than input cavity radius), and anode plate 25 has a thickness of approximately 0.450". Additionally, characteristics of the gun anode 22 are modified to achieve desired beam characteristics, with dimensions including a gun anode aperture 23 of appx. 0.276". Other dimensions of components of the accelerator may also change (for example, in some embodiments, it may be desirable to modify the size and position of one or more vacuum pumping holes, other characteristics of the anode flange, the thickness or shape of the gun anode, or the like). Simulations of first half cavity 200 indicate that the cavity enjoys reduced dark current as compared to first half cavity 100.

In some embodiments, reduced dark current may be achieved by increasing the size of input aperture 202 as compared to the size of output aperture 204. In some embodiments, input aperture 202 is greater than the size of output aperture 204.

Although the present invention has been described with respect to a preferred embodiment thereof, those skilled in the art will note that various substitutions may be made to those embodiments described herein without departing from the spirit and scope of the present invention.

What is claimed is:

1. A linear accelerator, comprising:

a cavity having an input aperture and an output aperture;

a particle source coupled to said input aperture, said input aperture having a radius greater than a radius of said output aperture; and an anode plate, coupled between said particle source and said input aperture, said anode plate having a thickness and an opening forming said input aperture.

2. The linear accelerator of claim 1, wherein said input aperture and said output aperture are substantially circular in shape.

3. The linear accelerator of claim 1, wherein said thickness of said anode plate is selected to attain a resonant frequency of said particles in said linear accelerator.

4. The linear accelerator of claim 1, wherein said radius of said input aperture is selected to reduce a dark current beam generated from said anode plate.

5. The linear accelerator of claim 1, wherein said particle source is an electron gun having a gun anode, said gun anode having an anode aperture and a thickness.

6. The linear accelerator of claim 5, wherein said thickness of said gun anode and a size of said anode aperture are selected to attain a resonant frequency of said particles in said linear accelerator.

7. An accelerator, comprising a plurality of accelerating cavities, disposed along a beam axis, including a first half cavity having an input aperture and an output aperture positioned along said beam axis; and an anode plate forming a wall of said first half cavity, said anode plate having an opening forming said input aperture, wherein said opening is sized to reduce the dark current generated by said anode plate.

8. A cavity for a linear accelerator, comprising:

an input aperture having a first radius; and an output aperture having a second radius smaller that said first radius;

said input aperture receiving particles from a particle source, and directing said particles to said output aperture;

wherein a first wall of said cavity is an anode plate, wherein an opening of said anode plate forms said input aperture.

9. The cavity of claim 8, wherein said input and said output apertures are substantially circular in shape.

10. The cavity of claim 8, wherein said first radius is selected to reduce a dark current beam generated from said anode plate.

11. The cavity of claim 8, wherein said particle source includes an electron gun having a gun anode having a gun anode aperture.

12. A method for reducing dark current in an accelerator having a first half cavity with an input aperture and an output aperture, comprising:

increasing a size of said input aperture to reduce a dark current beam generated from a wall of said first half cavity; and modifying a thickness of said wall and a shape of an electron gun anode to achieve desired operating characteristics of said accelerator.

13. The method of claim 12, wherein said size of said input aperture is greater that a size of said output aperture.

14. The method of claim 12, wherein said thickness of said wall is reduced.

15. The method of claim 12, wherein a thickness of said electron gun anode is reduced.

16. The method of claim 12, further comprising:

increasing the height of said first half cavity to achieve desired operating characteristics of said accelerator.

* * * * *